US006164162A

United States Patent [19]

Furundzic

[11] Patent Number: 6,164,162

[45] Date of Patent: Dec. 26, 2000

[54] HOSE CLAMP TOOL

[76] Inventor: Rade Furundzic, 7640 W. Lake St., Morton Grove, Ill. 60053

[21] Appl. No.: 09/233,271

[22] Filed: Jan. 19, 1999

[51] Int. Cl.[7] ..... B25B 27/10

[52] U.S. Cl. ..... 81/9.3; 29/229; 29/243.56

[58] Field of Search ..... 81/9.3, 485, 486, 81/158, 162, 175, 176; 29/225, 229, 243.56; 269/243

[56] References Cited

U.S. PATENT DOCUMENTS

| | | | |
|---|---|---|---|
| 1,029,142 | 6/1912 | Reeves . | |
| 1,051,727 | 1/1913 | Gardner . | |
| 1,886,146 | 11/1932 | Andrews . | |
| 2,188,161 | 1/1940 | Rosenmund | 140/123 |
| 2,227,397 | 12/1940 | Lucker | 254/106 |
| 2,234,970 | 3/1941 | Lucker | 254/106 |
| 2,677,982 | 5/1954 | Arras et al. | 81/9.3 |
| 2,884,824 | 5/1959 | Sherman | 81/3 |
| 2,910,899 | 11/1959 | Pasqualone et al. | 81/9.3 |
| 3,091,143 | 5/1963 | Coy | 81/9.3 |
| 3,161,086 | 12/1964 | Kircher | 81/9.3 |
| 3,518,993 | 7/1970 | Blake | 128/321 |
| 3,705,581 | 12/1972 | Drake | 128/83 |
| 3,727,291 | 4/1973 | Babb | 29/251 |
| 4,770,401 | 9/1988 | Donaldson | 269/249 |
| 4,919,017 | 4/1990 | Thomas | 81/9.3 |
| 5,385,335 | 1/1995 | Wurdack | 254/1 |

FOREIGN PATENT DOCUMENTS 33 43 501 C1 2/1985 Germany .

*Primary Examiner*—D. S. Meislin
*Attorney, Agent, or Firm*—Olson & Hierl, Ltd.

[57] ABSTRACT

A tool is disclosed for use in installing and removing a resilient ring clamp having overlapping ends, each end having a radially extending lug thereon. The tool squeezes the lugs of the clamp to increase the circumference of the clamp so that the clamp can be slipped over a hose. A frictional drive assembly moves a shoe rod outwardly from a housing such that a shoe on the distal end of the shoe rod moves toward a hook on the distal end of a hook rod extending from the housing, thus squeezing the lugs of the clamp between the shoe and the hook. The hook rod can be selectively positioned around the shoe rod so that the hook and shoe can be oriented in a selected direction without axially rotating the housing.

4 Claims, 9 Drawing Sheets

HOSE CLAMP TOOL

TECHNICAL FIELD OF THE INVENTION

This invention relates to hand tools for installing and removing resilient ring clamps and, more particularly, to a hand tool having a frictional drive assembly for moving a shoe toward a hook to perform a squeezing operation on a circular hose clamp having overlapping ends with radially extending lugs thereon.

BACKGROUND OF THE INVENTION

Hose clamps are commonly used in a variety of applications that require hose connections in fluid systems such as engine cooling systems, air pressure systems, and many other gas and liquid circuits. For example, the cooling system of an automobile employs a number of hoses for circulating the antifreeze solution to and from the radiator. Also, laundry machines have hoses that supply and drain water to and from the washing tub. These systems require hose clamps to secure the ends of the hoses to the various parts of the machines.

The typical hose clamp is made of a flat, resilient, circular band with overlapping ends turned outwardly at their extremities to form lugs extending generally radially from the clamp and spaced angularly in accordance with the amount of overlap of the ends. Generally, hose clamps are made of flat metal bands, but can also be made of heavy spring wire similarly configured.

The hose clamp is installed or removed by squeezing the lugs together to spring the clamp outwardly to an increased circumference so that it may be slipped over the hose and moved to the proper clamping position or so that it may be loosened and slipped off of the hose connection. During installation, the lugs are then released to permit the ring to resiliently tighten itself around the hose.

During the manufacturing of machines that include hoses, the hoses and clamps typically must be installed among an ever-increasing number of parts or components that are crowded into ever-decreasing spaces. Moreover, because of the crowded nature of modern machines, the hose clamps are difficult to reach when the machines need repair.

Very often the tools used to assist in the installation or removal of hose clamps are cumbersome and require the operator to maneuver his or her hands in an inconvenient and uncomfortable manner. For example, a plier-type tool requires that the tool be oriented such that the lugs of the hose clamp are positioned between the jaws of the tool; but in doing so, the handle of the tool may extend in an inconvenient direction. Also, other parts of the machine may physically interfere with the operation of the tool in a crowded space.

Thus, there continues to be a need for a method and apparatus for installing or removing hose clamps that is capable of use in a machine that is crowded with components. The tool should be able to reach a hose clamp that is oriented inconveniently without requiring the operator to maneuver his or her hands in an uncomfortable or inconvenient manner. The present invention meets these desires.

SUMMARY OF THE INVENTION

A hose clamp tool embodying the present invention performs a squeezing operation on a resilient circular hose clamp having overlapping ends and lugs extending radially from the ends. The squeezing of the lugs toward each other increases the circumference of the hose clamp so that the clamp can be slipped over a hose during installation or removal. The hose clamp tool thus assists in the installation and removal of the clamp.

The hose clamp tool of the present invention comprises a hollow housing including a front wall that defines a front wall hole. An axially movable shoe rod having a distal end region and a proximal end region extends through the housing. The distal end region of the shoe rod extends through the front wall hole of the housing while the proximal end region is at least partially within the housing.

A shoe is on the distal end region of the shoe rod for engaging one of the lugs of the hose clamp.

A hook rod extends from the front wall of the housing generally parallel to the shoe rod. The hook rod includes a distal end and a proximal end.

The distal end of the hook rod has a hook disposed thereon for engaging the other lug of the hose clamp such that the hose clamp is held between the hook and the shoe when both the hook and the shoe are engaged with respective lugs of the hose clamp. The proximal end of the hook rod is associated with the front wall of the housing.

A frictional drive assembly is located within the housing and is operably associated with the shoe rod for moving the shoe rod outwardly from the housing. The shoe moves toward the hook when the drive assembly moves the shoe rod outwardly, thereby squeezing the lugs of the hose clamp toward each other.

There are other advantages and features of the present invention which will be more readily apparent from the following detailed description of the preferred embodiment of the invention, the drawings, and the appended claims.

DESCRIPTION OF THE PREFERRED EMBODIMENT

Figure 1:
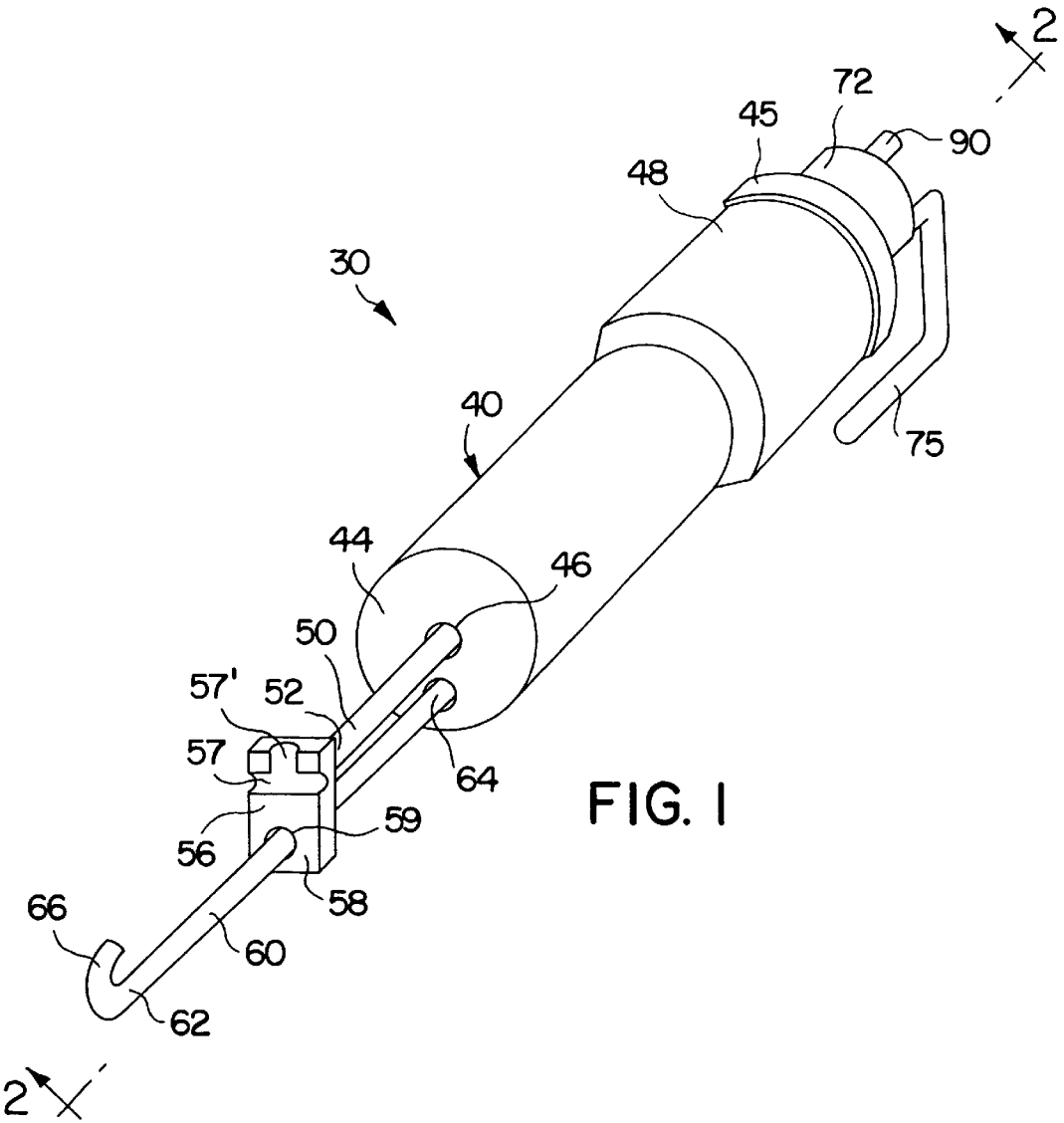
FIG. 1 is a perspective view of a hose clamp tool in accordance with the present invention.

The invention disclosed herein is, of course, susceptible of embodiment in many different forms. Shown in the drawings and described hereinbelow in detail are preferred embodiments of the invention. It is to be understood, however, that the present disclosure is an exemplification of the principles of the invention and does not limit the invention to the illustrated embodiments.

For ease of description, a tool embodying the present invention is described hereinbelow in its usual assembled position as shown in the accompanying drawings, and terms such as forward, rear, horizontal, longitudinal, etc., may be used herein with reference to this usual position. However, the tool may be manufactured, transported, sold, or used in orientations other than that described and shown herein.

Referring to FIGS. 1–4, a tool 30 embodying the present invention provides a hose clamp tool for installing and removing resilient ring clamps such as hose clamps.

Figure 2:
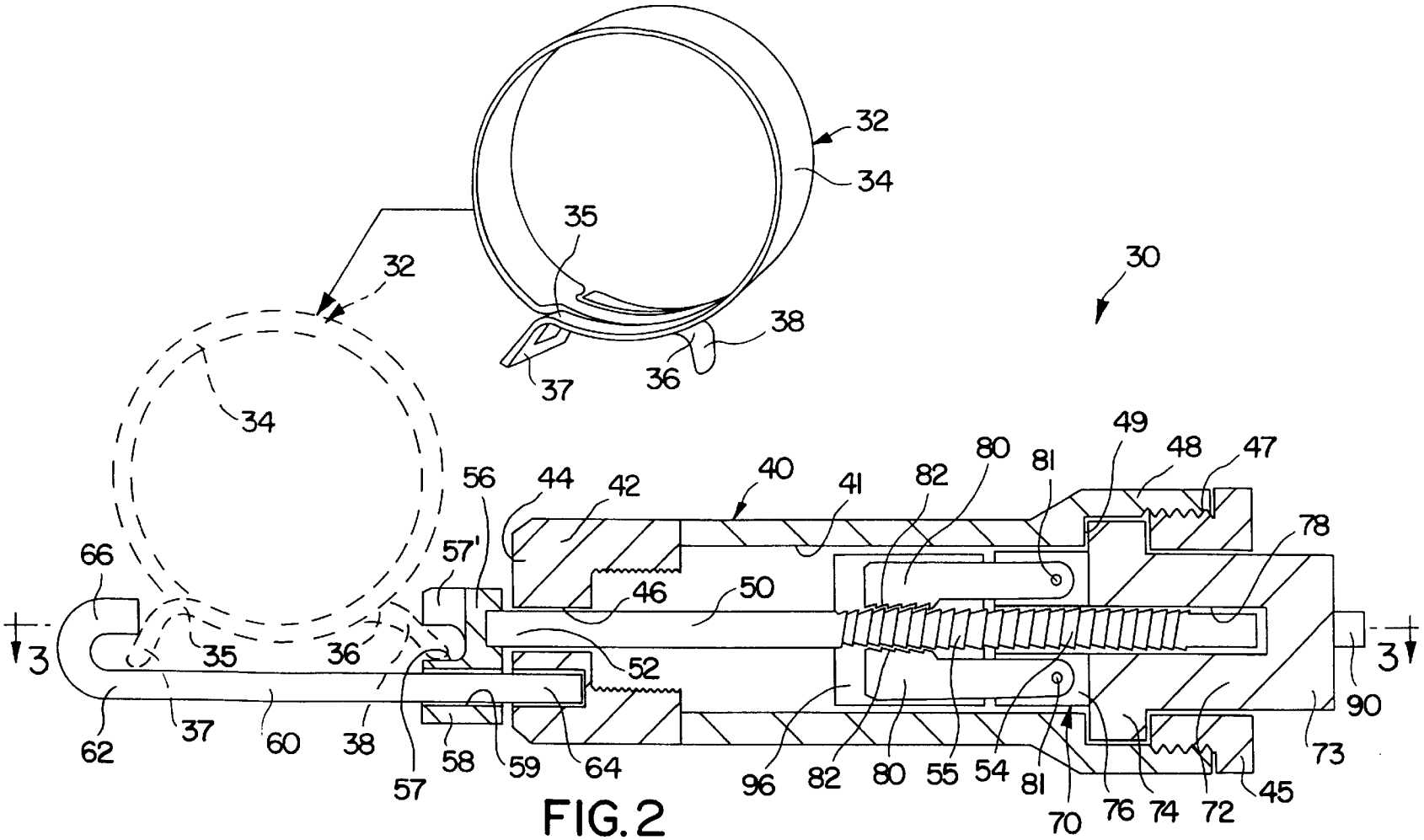
FIG. 2 is a sectional side view of the hose clamp tool of FIG. 1, taken along line 2—2, and showing a drive assembly.

A typical hose clamp 32 is shown in FIG. 2 for illustrative purposes only and forms no part of the present invention. The resilient ring clamp 32 is typically made of a flat, resilient, circular band 34 with overlapping ends 35 and 36 turned outwardly at their extremities to form lugs 37 and 38, respectively. The lugs extend generally radially from the clamp 32 and are spaced angularly in accordance with the amount of overlap of the ends. Generally, hose clamps are made of flat metal bands, but can also be made of heavy spring wire similarly configured.

When the lugs 37 and 38 are squeezed toward each other, the circumference of the hose clamp 32 increases as the amount of overlap of the ends 35 and 36 decreases, thus loosening the hose clamp to allow it to be slipped over a hose. When the lugs are released, the hose clamp resiliently tightens itself around the hose, thereby clamping the hose to a collar or rigid tube extending into the end region of the hose.

A preferred embodiment of the tool 30 includes a hollow housing 40. The housing 40 is preferably elongated and generally tubular, but can be any suitable shape for enclosing the mechanism described below and for serving as a handle during operation of the tool 30.

Figure 3:
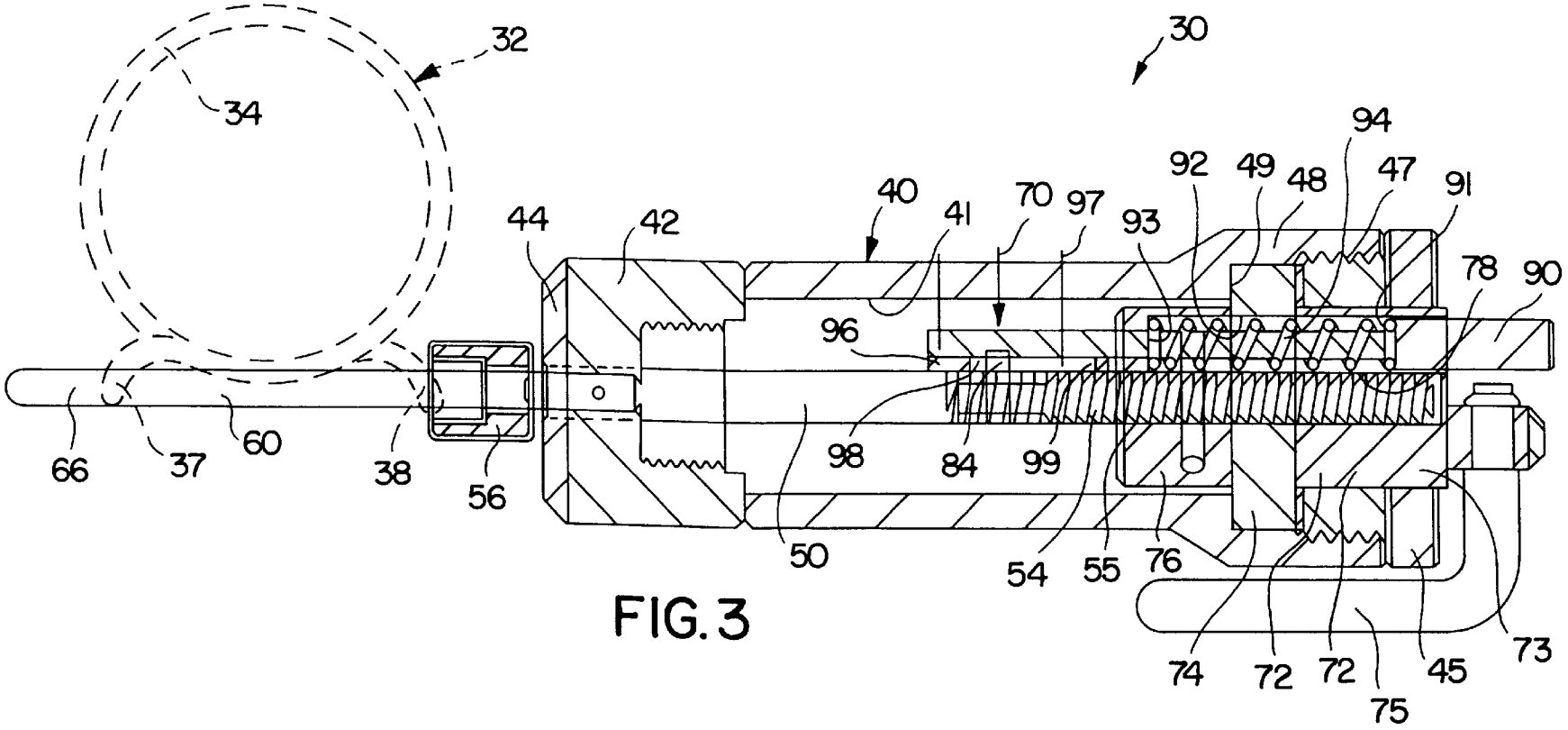
FIG. 3 is a sectional top view of the tool of FIG. 1, taken along line 3—3 of FIG. 2.

In the embodiment shown in FIGS. 1–3, the housing 40 preferably has a closed front portion 42 that includes a front wall 44. The front wall 44 is generally perpendicular to a longitudinal central axis of the housing 40. Also, the front wall 44 defines a front wall hole 46 that is generally coaxial with the central axis of the housing 40.

An axially movable shoe rod 50 extends longitudinally through the housing 40. The shoe rod 50 has a distal end region 52 and a proximal end region 54. The distal end region of the shoe rod extends through the front wall hole of the housing while the proximal end region is at least partially within the housing. The proximal end region 54 can extend through the rear portion 48 of the housing 40.

As described in detail below, the shoe rod is operably associated with a frictional drive assembly 70 that moves the shoe rod outwardly from the housing in a forward direction.

A shoe 56 is on the distal end region 52 of the shoe rod 50. The shoe 56 is for engaging one of the lugs of the hose clamp during the installation or removal of the hose clamp 32. In the preferred embodiment, the shoe 56 defines a groove 57 into which one of the lugs is seated when the shoe engages the lug. The groove 57 helps to keep the hose clamp from slipping out of the grip of the tool 30 during use. Groove 57 preferably extends laterally across the front face of shoe 56, but may also include a perpendicular portion 57' as shown in FIG. 1.

A hook rod 60 extends from the front wall 44 of the housing 40. The hook rod 60 is generally parallel to the shoe rod 50 and includes a distal end 62 and a proximal end 64. The proximal end 64 of the hook rod 60 is associated with the front wall 44 of the housing 40. The hook rod 60 can be attached to the front wall 44 either fixedly or removably. Also, configurations of the front wall 44 can be provided so that the hook rod 60 can be selectively positioned circumferentially around the shoe rod 50. These configurations are discussed in detail below.

The distal end 62 of the hook rod 60 has a hook 66 disposed thereon for engaging the other lug of the hose clamp 32. The hose clamp 32 is held between the hook 66 and the shoe 56 when both the hook 66 and the shoe 56 are engaged with respective lugs of the hose clamp 32. It will be apparent to those of ordinary skill in the art that the clamp 32 can be oriented sideways, as illustrated in FIG. 3, i.e., about 90 degrees from the orientation shown in FIG. 2. The hook and shoe thus can engage the lugs in this sideways orientation. The sideways orientation is particularly suited to clamps made from heavy spring wire as opposed to a flat metal band.

A guide portion 58 preferably extends from the shoe 56 and defines a guide hole 59 through which the hook rod 60 extends. As the shoe rod moves outwardly from the housing, the shoe including the guide portion slides along the hook rod 60. The guide portion 58 of the shoe 56 guides movement of the shoe rod 50 in a parallel direction with respect to the hook rod 60. The shoe 56 is thus slidably associated with the hook rod 60.

When the lugs of the clamp are between the hook and the shoe, the outward movement of the shoe rod squeezes the lugs of the hose clamp between the hook and the shoe and thus toward each other. As described above, when the lugs are squeezed toward one another, the circumference of the clamp increases, thereby allowing the clamp to be slipped over a hose for installation or loosened for removal from a hose.

Figure 4:
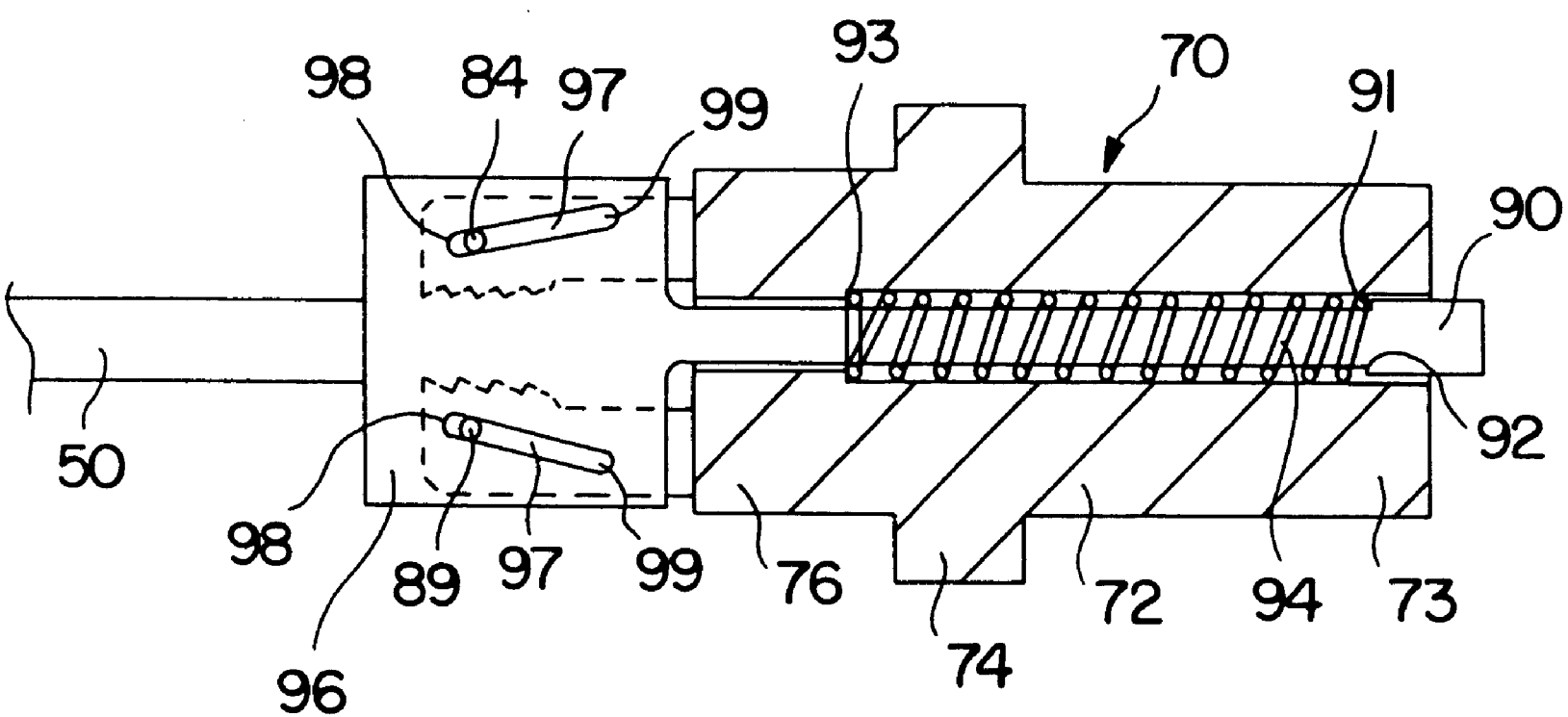
FIG. 4 is a sectional opposite side view of the drive assembly of the tool of FIG. 1.

The frictional drive assembly within the housing 40 is the mechanism by which the shoe rod moves outwardly from the housing. An example of one preferred embodiment of a frictional drive assembly 70 is illustrated in FIGS. 2–4. The drive assembly 70 is located within the housing 40 generally near the rear portion 48.

As shown in FIGS. 2 and 3, the housing 40 includes an open rear portion 48, an interior surface 41, and an annular shoulder 49 on the interior surface 41. The annular shoulder 49 is located inwardly of the open rear portion 48. The interior surface 41 also defines a threaded section 47 near the open rear end of the housing.

The drive assembly 70 is operably associated with the shoe rod 50 for moving the shoe rod 50 outwardly from the housing 40. When the drive assembly 70 is engaged, it operates to move the shoe rod 50 outwardly from the housing, such that the shoe 56 moves toward the hook 66 to squeeze together the lugs of a hose clamp that is held between the shoe and the hook.

Drive assembly 70 of FIGS. 2–4 is operably associated with the shoe rod 50 that includes a threaded portion 55 at the proximal end region 54 of the shoe rod 50.

The drive assembly 70 includes a generally cylindrical drive body 72 which has a radially extending flange 74 configured to abut the annular shoulder 49 of the housing 40. The drive assembly 70 is thus nested into the open rear portion 48 of the housing 40. The drive body 72 further includes a protrusion 76 that extends from the drive body 72 forwardly of the flange 74. Also, the drive body 72 defines an axial bore 78 for accepting the proximal end region 54 of the shoe rod 50. When the drive assembly 70 is nested into the housing 40, the drive body 72 is coaxially rotatable about the shoe rod 50.

A threaded retaining plug 45 is threadably mated with the threaded section 47 of the rear portion 48 to hold the drive body 72 within the housing 40. The retaining plug 45 abuts the flange 74 of the drive body 72 such that the flange 74 is captured between the shoulder 49 of the housing 40 and the retaining plug 45. The flange 74 and the space between the shoulder 49 and the plug 45 preferably are dimensioned so that the flange 74 remains rotatable between the shoulder 49 and the plug 45 when the drive assembly 70, the housing 40, and the retaining plug 45 are assembled.

A jaw 80 is pivotally mounted to the protrusion 76. Preferably, and as exemplified in FIGS. 2–4, a pair of jaws 80 is provided for threadably engaging the threaded portion 55 of the shoe rod 50. The jaw 80 preferably extends in the direction of the front wall 44 from its pivot point 81 on the protrusion 76. The jaw 80 includes a toothed section 82 that threadably engages with the threaded portion 55 of the shoe rod 50. The jaw 80 can be pivoted away from the shoe rod 50 to disengage the toothed section from the threaded portion 55. Disengagement of the jaw from the shoe rod allows the shoe rod to be retracted or pushed back into the housing 40.

In operation, the shoe rod 50 moves outwardly from the housing 40 when the drive assembly 70 is rotated coaxially around the shoe rod 50 while the jaw 80 is engaged with the threaded portion 55.

A release rod 90 is carried by the drive body 72 in a release rod bore 92 which is defined by the drive body. The release rod bore 92 is generally parallel to the axial bore 78 and radially spaced from the axial bore 78. The release rod 90 is operably associated with the jaw 80, as described below, for releasing the jaw 80 from engagement with the threaded portion 55 of the shoe rod 50.

The release rod 90 is biased rearwardly by a coil spring 94 that is disposed around the release rod 90 within the release rod bore 92. The spring 94 is disposed between a step 91 defined on the release rod 90 and a rear-facing shoulder 93 within the bore 92.

A guide plate 96 is disposed at the forward end of the release rod 90 and is generally parallel to the jaw 80. The guide plate 95 is preferably integral with the release rod and defines an angled slot 97 that is operably associated with the jaw 80. The angled slot 97 has a forward end 98 and a rear end 99, and is angled such that the forward end 98 is closest to the shoe rod 50. The preferred embodiment, as shown in FIG. 4, includes two slots in the guide plate 96, each slot associated with a corresponding jaw 80.

Each angled slot 97 is configured to accept a pin 84 attached to and extending laterally from a corresponding jaw 80. When the guide plate 96 is in its normal position, i.e., biased rearwardly with respect to the drive assembly 70, the pin 84 of the jaw 80 is located near the forward end 98 of the slot 97. As the release rod 90 is pushed inwardly, i.e., forwardly, the guide plate 96 slides forward relative to the jaw 80 and past the pin 84, carrying the pin toward the rear end 99 of the slot 97. Thus, the slot 97 moves the pin and jaw away from the shoe rod 50, and the jaw is disengaged from the shoe rod.

Referring to FIG. 3, a handle 75 can be provided on the rear end 73 of the drive body 72 for assisting in rotating the drive body. The handle 75 is preferably attached to the drive body 72 and extends generally radially from the drive body 72. The handle 75 can be L-shaped such that a portion of the handle extends parallel to the housing 40.

Figure 5:
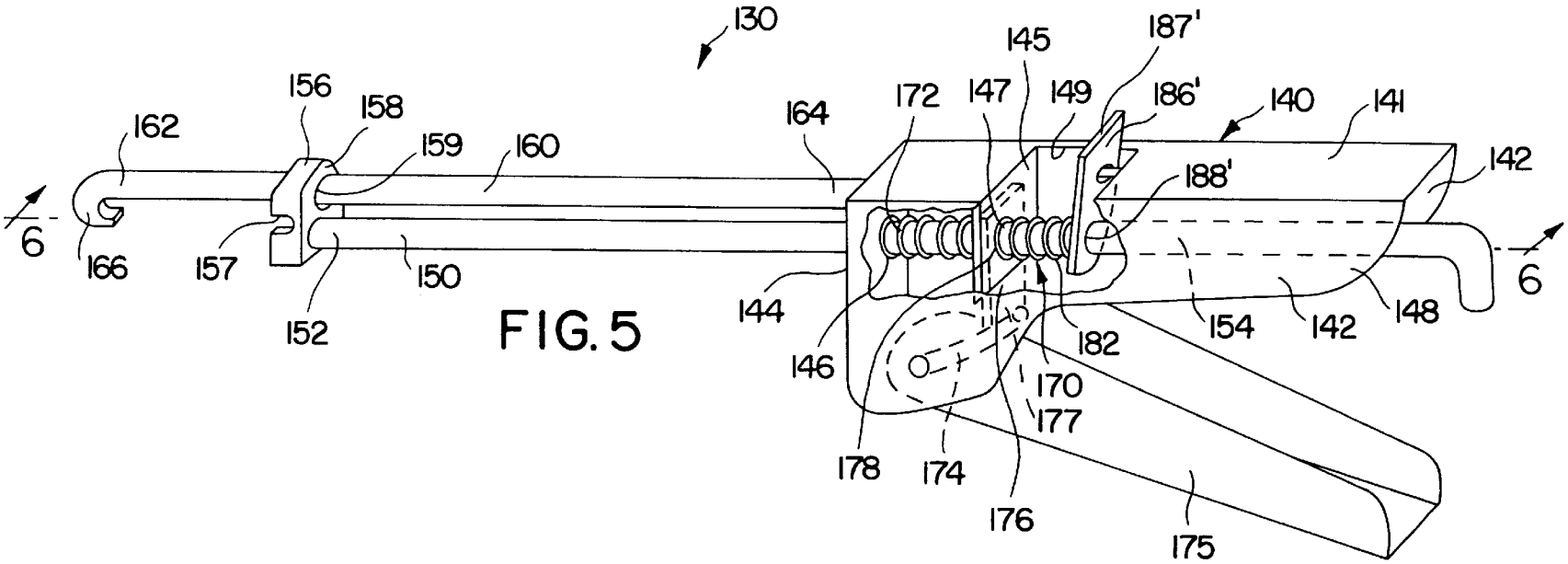
FIG. 5 is a perspective view of another embodiment of a hose clamp tool in accordance with the present invention.
Figure 6:
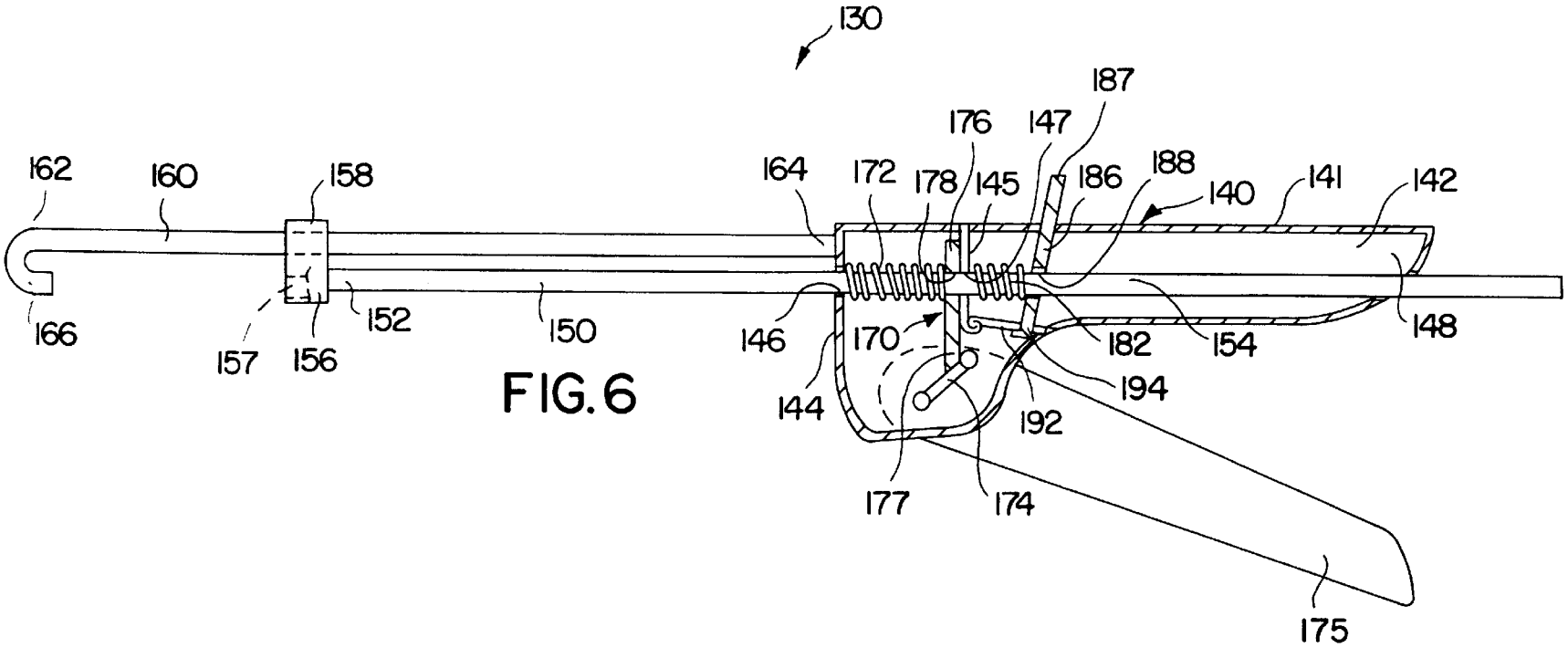
FIG. 6 is a partial sectional view of the tool of FIG. 5, taken along line 6—6.

Another preferred embodiment of the hose clamp tool is exemplified by tool 130, shown in FIGS. 5 and 6.

Tool 130 includes a hollow housing 140 that preferably has a top wall 141, opposed side walls 142 and 143 extending generally perpendicularly from the top wall 141, and a front wall 144 extending generally perpendicularly from the top wall 141 and between the side walls. The top, side, and front walls of the housing define an interior space in which a frictional drive assembly 170 is disposed. Front wall 144 defines a front wall hole 146, and the top wall 141 defines a top wall opening 189. The housing 140 includes an open rear portion 148. Alternatively, rear portion 148 can be closed.

Housing 140 also includes a middle wall 145 that is generally parallel to front wall 144, generally perpendicular to side walls 142 and 143, and is located proximally to the front wall 144. The middle wall 145 defines a middle wall hole 147.

While the housing 140 is preferably made of metal, molded plastic or any other material suitable for use in hand tools car be used, as is well known in the art.

Tool 130 also includes a shoe rod 150 and a hook rod 160 that are similar to the shoe rod 50 and hook rod 60 of the previously described embodiment.

The shoe rod 150 is axially movable and extends longitudinally through the housing 140. The shoe rod 150 has a distal end region 152 and a proximal end region 154. The distal end region 152 of the shoe rod 150 extends through the front wall 144 of the housing 140 while the proximal end region 154 is at least partially within the housing. The proximal end region 154 extends through the middle wall hole 147 and can extend from the rear portion 148 of the housing 140.

The shoe rod 150 is operably associated with the frictional drive assembly 170 that moves the shoe rod outwardly from the housing in a forward direction, as described below.

A shoe 156 is on the distal end region 152 of the shoe rod 150. The shoe 156 is for engaging one of the lugs of the hose clamp as described above with respect to the previously described embodiment of the hand tool 130. Similarly to the previously described embodiment, shoe 156 defines a groove 157 into which one of the lugs of the hose clamp is seated during use of the tool. Also, a guide portion 158 defining a guide hole 159 extends from the shoe 156.

A hook rod 160 extends from the front wall 144 of the housing 140. The hook rod 160 is generally parallel to the shoe rod 150 and includes a distal end 162 and a proximal end 164. The proximal end 164 is associated with the front wall 144 of the housing 140. The distal end 162 of the hook rod 160 has a hook 166 disposed thereon for engaging the other lug of the hose clamp. The hook rod 160 can be attached to the front wall 144 either fixedly or removably. Also, configurations of the front wall can be provided so that the hook rod 160 can be selectively positioned circumferentially around the shoe rod 150. These configurations are discussed in detail below.

The hook rod 160 extends through the guide hole 159 of the guide portion 158 of the shoe 156. As previously described, the shoe rod 150 is moved outwardly from the housing 140, and the shoe including the guide portion slides along the hook rod 160. The guide portion 158 guides the movement of the shoe rod 150 in a parallel direction with respect to the hook rod 160. The shoe 156 is thus slidably associated with the hook rod 160. The frictional drive assembly 170 is the mechanism by which the shoe rod 150 moves outwardly from the housing 140.

The frictional drive assembly 170 includes a forward return spring 172 located between the front wall 144 and the middle wall 145. The drive assembly also includes a pushing plate 176 having an extended portion 177 and defining a pushing hole 178 through which the shoe rod 150 extends. The pushing plate 176 is located between the front and middle walls and is normally biased toward the middle wall 145 by the forward return spring 172.

The pushing plate 176 is normally generally perpendicular to the shoe rod 150. The shoe rod 150 is slidable through the pushing hole 178 when the pushing hole 178 is generally axially aligned with the shoe rod 150. When the pushing hole 178 is canted with respect to the shoe rod 150, the shoe rod becomes frictionally engaged with the pushing plate.

An actuating arm 174 is pivotally mounted to the housing 140 and operably associated with the extended portion 177 of the pushing plate 176. In operation, the actuating arm 174 pivots toward the extended portion 177 and moves the extended portion forward to cant the pushing plate 176, thereby frictionally engaging the pushing plate with the shoe rod 150 and moving the pushing plate and shoe rod forward. As the actuating arm is further pivoted, the pushing plate and the shoe rod are moved forward together as they are pushed by the actuating arm.

A handle 175 is preferably provided for pivoting the actuating arm 174. Handle 175 is also pivotally attached to the housing 140 and is operably associated with the actuating arm 174. The handle 175 and the actuating arm 174 can be unitary or integral, i.e., the actuating arm 174 can be formed as part of the handle 175.

A rear return spring 182 is located behind the middle wall 145 and in front of a locking plate 186. The locking plate 186 has a protruding portion 187 and defines a locking hole 188 through which the shoe rod 150 extends. The protruding portion 187 protrudes from an opening 149 in the top wall 141 of the housing 140. The locking plate 186 is pivotally attached to the housing 140 such that the rear return spring 182 holds the locking plate 186 in a normally canted position with respect to the shoe rod 150. Preferably, and as shown in FIG. 4, the locking plate 186 includes a pivot arm 192 which extends from the lower end 194 of the locking plate. The lower end 194 is opposite the protruding portion 187. The pivot arm 192 is preferably pivotally attached to the middle wall 145.

In use, the locking plate 186 is pivotable into a generally perpendicular position with respect to the shoe rod 150 and is normally canted so as to be frictionally engaged with the shoe rod to hold the shoe rod in a forward position. The shoe rod 150 is slidable through the locking hole 188 when the locking plate is pivoted such that the locking hole is generally axially aligned with the shoe rod. The friction between the shoe rod 150 and the locking plate hole 188 serves to pivot the locking plate 186 into the generally perpendicular position as the shoe rod is moved forward. After the shoe rod 150 has been moved forward, the rear return spring 182 biases the locking plate 186 into the normally canted position, thus frictionally engaging the shoe rod and holding it in position. The shoe rod can be released by pivoting the locking plate 186 forward in order to axially align the locking hole 188 with the shoe rod. The locking plate can be pivoted by urging the protruding portion 187 forwardly. The shoe rod 150 can then be manually pulled back such that the shoe 156 is moved away from the hook 166. If a clamp has been engaged, the shoe 156 can be disengaged from the lug of the hose clamp by manually pulling back the shoe rod 156, or the spring force of the lug and clamp can push the shoe rod back.

Referring to FIG. 5, an alternate embodiment of the locking plate is illustrated. Locking plate 186' is pivotally attached to the housing 140 at a point near the protruding portion 187' which is above the locking plate hole 188' and the shoe rod 150. In operation, the embodiment shown in FIG. 5 operates similarly to that of FIG. 6 except that after the shoe rod 150 is moved forward, it can be released by urging the protruding portion 187' in a backward direction so as to pivot the locking plate 186' such that the locking plate hole 188' is disengaged from the shoe rod.

FIGS. 7–10 illustrate an alternate configuration of front wall 244 that can be provided so that the hook rod 260 can be selectively positioned circumferentially around the shoe rod 250. These configurations can be provided on any of the previously described embodiments of the hand tool. Reference to tool 30 and its corresponding series of reference numerals is intended also to include the features of tool 130 and its corresponding series of reference numerals.

The ability to selectively position the hook rod around the shoe rod allows the operator of the hand tool to orient the hook and shoe conveniently such that the operator's hand can be comfortably positioned when installing or removing a hose clamp that is oriented with the lugs pointing in a direction that may be difficult to reach. One alternate embodiment of the tool 30 includes a turret assembly 220 that can be rotated to selectively position the hook rod 260.

The turret assembly 220 is rotatably mounted through the front wall hole 246. The turret assembly 220 defines a turret hole 222 coaxially with the front wall hole 246 through which the shoe rod 250 slidably extends. The proximal end 264 of the hook rod 260 is mounted to the turret assembly 220.

The turret assembly 220 includes a cylindrical collar 224 coaxially and rotatably positioned within the front wall hole 222. A front flange 226 is attached to the collar 224 and is adjacent to the exterior surface 245 of the front wall 244. The hook rod 260 is mounted to the front flange 226.

Figure 8:
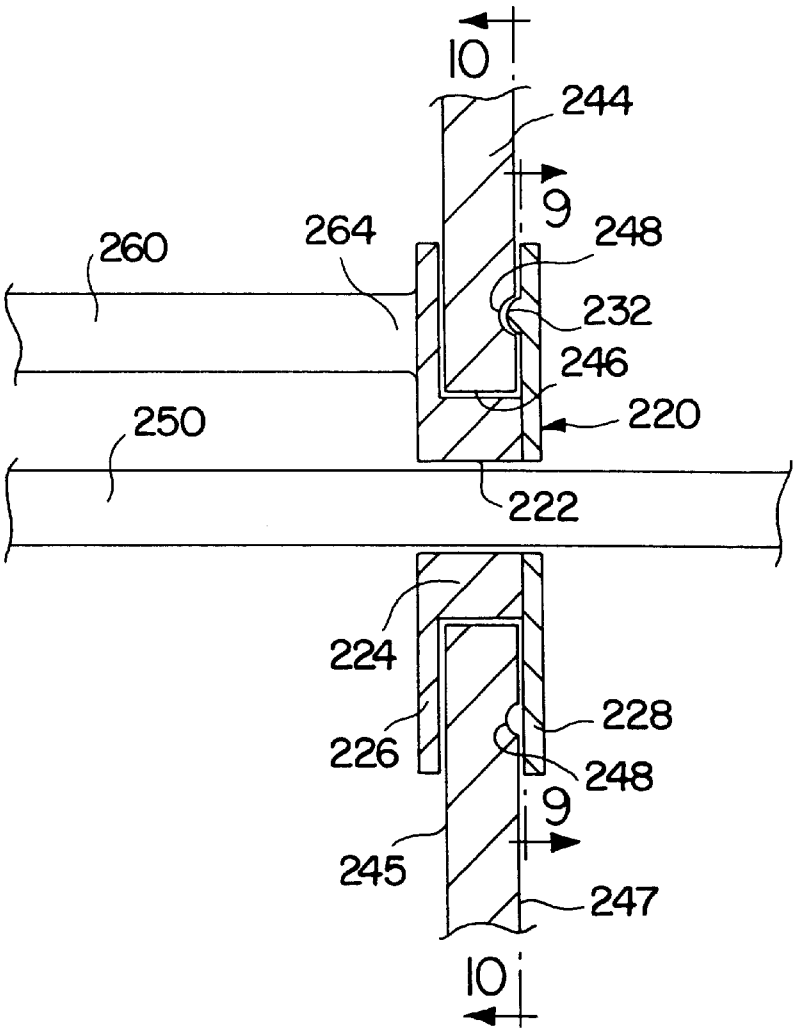
FIG. 8 is an enlarged partial sectional view of the turret assembly taken along line 8—8 of FIG. 7.
Figure 7:
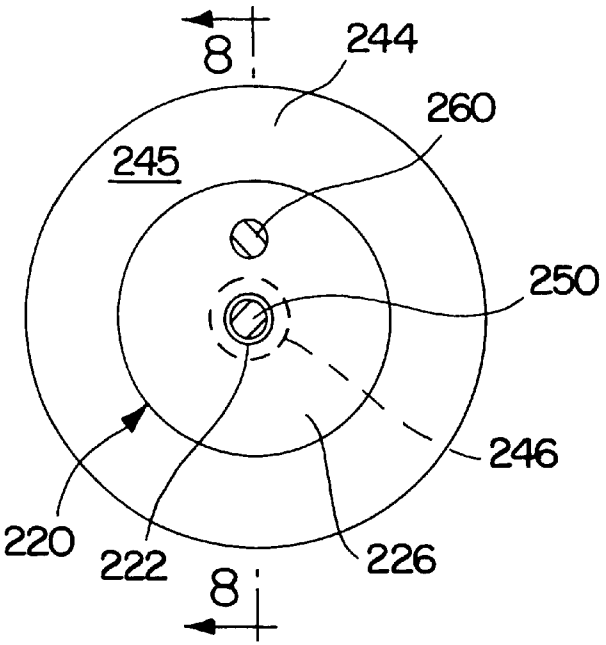
FIG. 7 is a front view of the tool showing a turret assembly.
Figure 10:
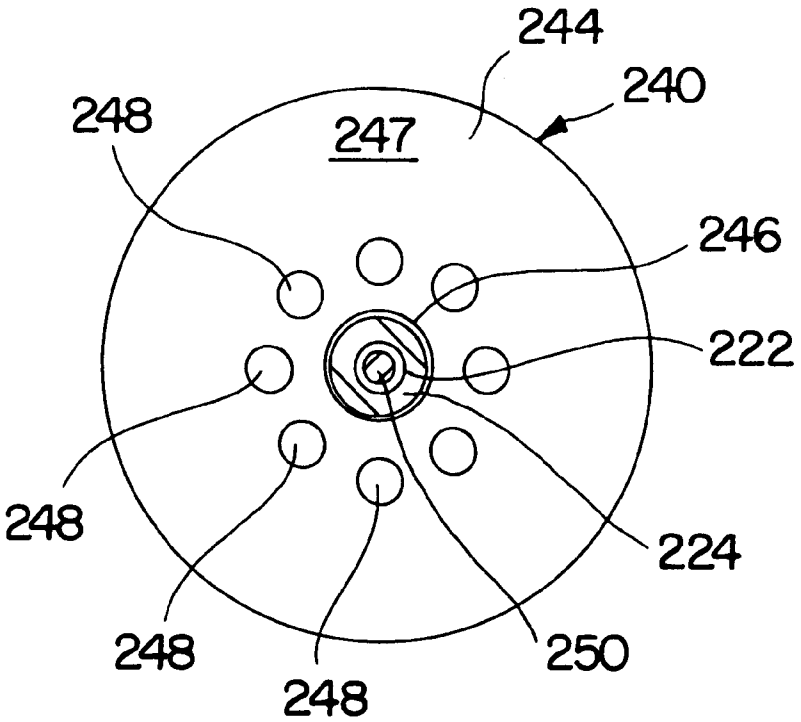
FIG. 10 is a partial sectional view taken along line 10—10 of FIG. 8.
Figure 9:
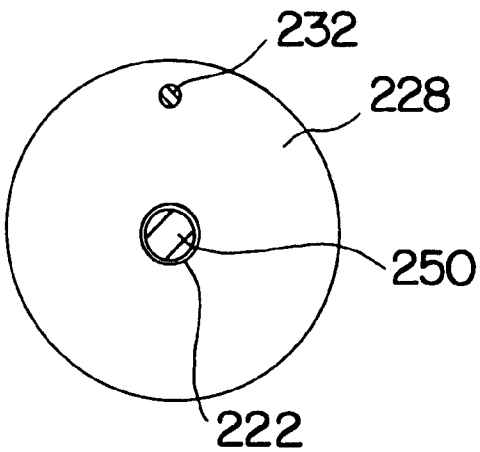
FIG. 9 is a partial sectional view taken along line 9—9 of FIG. 8.

A backing plate 228 is attached to the collar 224 and is adjacent to the interior surface 247 of the front wall 244. As shown in FIGS. 8 and 9, the backing plate 228 preferably has a protuberance 232 extending toward the interior surface 247 of the front wall 244. As shown in FIGS. 8 and 10, the interior surface 247 of the front wall 244 defines a complementary recess 248 into which the protuberance 232 is seated when the turret assembly 220 is rotated to align the protuberance with the recess.

Preferably, a plurality of recesses 248 is provided so that the turret assembly 220 can be rotated into any of a number of positions corresponding to the number of recesses. When the protuberance 232 is seated in the recess 248, the hook rod 260 is held in place at the selected location relative to the shoe rod 250. Thus, the orientation of the hook and shoe relative to the tool housing can be selected.

Figure 11:
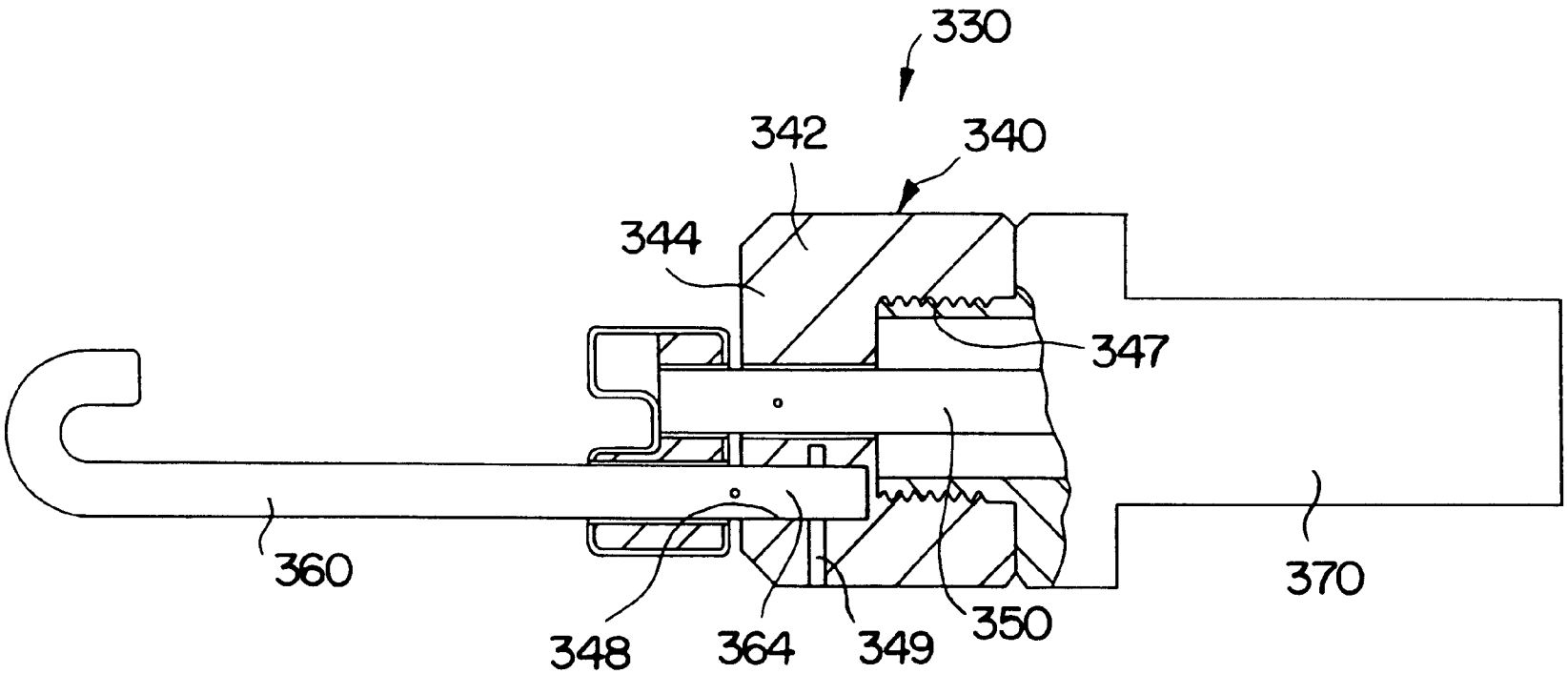
FIG. 11 is a partial sectional side view of a front portion of the hose clamp tool.

Yet another alternate embodiment of the invention is exemplified in tool 330, shown in FIG. 11. A front wall 344 defines a positioning hole 348 located radially from the front wall hole 346 such that the proximal end 364 of the hook rod 360 is removably insertable into the positioning hole 348. Preferably, the front wall 344 defines a plurality of positioning holes 348 around the front wall hole 346 so that the hook rod 360 can be selectively located circumferentially around the front wall hole and the shoe rod 350.

A retaining pin 349 can be provided for releasably retaining the hook rod 360 within the selected positioning hole 348. Alternatively, the hook rod 360 can be releasably retained by any mechanical means known to those of ordinary skill in the art such as, for example, a set screw, screw threads, or a ball and socket locking mechanism.

FIG. 11 also illustrates an alternate embodiment of the tool 330 that includes a hollow housing 340 that has a front portion 342 and a rear portion (not shown). The front and rear portions of housing 340 are separable from each other so that a drive system 370 can be attached to the front portion 342.

The drive system 370 is attached to the front portion 342 at a mating surface 347. The mating surface 347 shown in FIG. 6 is on the interior of the housing 340 and proximate to the front wall 344. Preferably, and as shown in FIG. 11, the mating surface 347 is threaded, and the drive system 370 is threaded onto the front portion 342.

The drive system 370 can be pneumatic, hydraulic, or any other type suitable for moving a shoe rod outwardly as previously described with respect to the frictional drive assemblies. The shoe rod 350 is operably associated with the drive system 370. Drive system 370 performs the same function of moving the shoe rod 350 outwardly as the previously described frictional drive assemblies 70 and 170.

In accordance with a method for installing and removing a resilient ring clamp having overlapping ends, each end having a radially extending lug thereon, any of the previously described embodiments of the tool can be provided to practice the method.

As described above, the tool includes a housing having a front wall defining a front wall hole, a hook rod extending from the front wall and having a distal end with a hook thereon, and an axially movable shoe rod having a distal end with a shoe thereon and a proximal end within the housing. The distal end of the shoe rod extends through the front wall hole and terminates proximally of the hook.

A frictional drive assembly is operably associated with the proximal end of the shoe rod to move the shoe rod forwardly toward the hook.

The method further includes the steps of aligning the hook and the shoe with the lugs of the clamp; engaging the hook with one of the lugs of the clamp; moving the shoe rod forward from the housing with the drive assembly such that the shoe moves toward the hook; engaging the shoe with the other of the lugs of the clamp; and moving the shoe forward such that the lugs are squeezed together, thereby increasing the circumference of the clamp.

The foregoing description and the accompanying drawings are illustrative of the present invention. Still other variations and arrangements of parts are possible without departing from the spirit and scope of this invention.

What is claimed is:

1. A tool for use in installing and removing a resilient ring clamp having overlapping ends, each having a lug thereon, the tool comprising:

a hollow housing including a front wall, the front wall defining a front wall hole;

an axially movable shoe rod having a distal end region and a proximal end region, the distal end region extending through the front wall hole, the proximal end region being at least partially within the housing, the shoe rod having a shoe on the distal end region for engaging one of the lugs of the clamp;

a hook rod extending from the front wall of the housing generally parallel to the shoe rod, the hook rod including a distal end and a proximal end, the distal end having a hook disposed thereon for engaging the other of the lugs of the clamp such that the clamp is held between the hook and the shoe when both the hook and the shoe are engaged with the lugs, the proximal end of the hook rod being associated with the front wall of the housing; and a frictional drive assembly within the housing operably associated with the shoe rod for moving the shoe rod outwardly from the housing;

said shoe including a guide portion extending therefrom, the guide portion defining a guide hole through which the hook rod extends such that the shoe is slidably associated with the hook rod;

whereby when the drive assembly moves the shoe rod outwardly, the shoe moves toward the hook to squeeze the lugs toward one another thereby increasing the circumference of the clamp.

2. The tool of claim 1 wherein the housing includes an open rear portion, an interior surface, and an annular shoulder on the interior surface located inwardly of the open rear portion;

wherein the shoe rod includes a threaded portion at the proximal end region; and wherein the drive assembly includes a generally cylindrical drive body having a radially extending flange and a protrusion extending from the drive body forwardly of the flange, the drive body being nested into the open rear portion such that the flange abuts the annular shoulder of the housing, the drive body defining an axial bore for accepting the proximal end region of the shoe rod such that the drive body is coaxially rotatable about the shoe rod, a jaw pivotally mounted to the protrusion for threadably engaging the threaded portion of the shoe rod, and a release rod carried by the drive body and operably associated with the jaw for releasing the jaw from engagement with the threaded portion of the shoe rod, whereby when the drive assembly is rotated coaxially about the shoe rod and the jaw is engaged with the threaded portion, the shoe rod moves outwardly from the housing.

3. The tool of claim 1 wherein the housing includes a middle wall generally parallel to the front wall and located proximally to the front wall, the middle wall defining a middle wall hole through which the shoe rod extends; and wherein the drive assembly includes a forward return spring located between the front wall and the middle wall, a pushing plate having an extended portion and defining a pushing hole through which the shoe rod extends, the pushing plate being located between the front and middle walls and being normally biased toward the middle wall by the forward return spring such that the pushing plate is normally generally perpendicular to the shoe rod, the shoe rod being slidable through the pushing hole when the pushing hole is generally axially aligned with the shoe rod and frictionally engaged with the pushing plate when the pushing hole is canted with respect to the shoe rod, an actuating arm pivotally mounted to the housing and operably associated with the extended portion of the pushing plate such that as the actuating arm pivots toward the extended portion, the actuating arm moves the extended portion forward to cant the pushing plate, thereby frictionally engaging the pushing plate with the shoe rod and moving the pushing plate and shoe rod forward, a rear return spring located behind the middle wall, a locking plate defining a locking hole through which the shoe rod extends, the locking plate being pivotally attached to the housing behind the middle wall such that the rear return spring holds the locking plate in a normally canted position with respect to the shoe rod and the locking plate is pivotable into a generally perpendicular position with respect to the shoe rod, the locking plate being normally frictionally engaged with the shoe rod to hold the shoe rod in a forward position when the locking plate is canted, the shoe rod being slidable through the locking hole when the locking plate is pivoted such that the locking hole is generally axially aligned with the shoe rod.

4. A tool for use in installing and removing a resilient ring clamp having overlapping ends, each having a lug thereon, the tool comprising:

a hollow housing including a front portion and an open rear portion, the front portion having a front wall with an interior surface and an exterior surface, the front wall defining a front wall hole;

an axially movable shoe rod having a distal end region and a proximal end region, the distal end region extending through the front wall hole, the proximal end region being at least partially within the housing, the shoe rod having a shoe on the distal end region for engaging one of the lugs of the clamp;

a hook rod extending forwardly from the housing and generally parallel to the shoe rod, the hook rod including a distal end and a proximal end, the distal end having a hook disposed thereon for engaging the other of the lugs of the clamp such that the clamp is held between the hook and the shoe when both the hook and the shoe are engaged with the lugs, the proximal end of the hook rod being selectively positionable circumferentially around the shoe rod; and a frictional drive assembly within the housing operably associated with the shoe rod for moving the shoe rod outwardly from the housing;

said shoe including a guide portion extending therefrom, the guide portion defining a guide hole through which the hook rod extends such that the shoe is slidably associated with the hook rod;

whereby when the drive assembly moves the shoe rod outwardly, the shoe moves toward the hook to squeeze the lugs toward one another thereby increasing the circumference of the clamp.

* * * * *